United States Patent [19]

Doss

[11] 4,349,782

[45] Sep. 14, 1982

[54] SHIELDED DIFFERENTIATOR FOR AUTOMOTIVE IGNITION APPLICATIONS

[76] Inventor: James D. Doss, 905 Tewa Loop, Los Alamos, N. Mex. 87544

[21] Appl. No.: 209,158

[22] Filed: Nov. 21, 1980

[51] Int. Cl.[3] ..... F02P 17/00

[52] U.S. Cl. ..... 324/390; 324/395; 324/402

[58] Field of Search ..... 324/390, 395, 402

[56] References Cited

U.S. PATENT DOCUMENTS

| | | | |
|---|---|---|---|
| 2,323,931 | 7/1943 | Peters | 324/402 X |
| 3,743,922 | 7/1973 | Festos | 324/402 X |
| 3,763,421 | 10/1973 | Glomski | 324/402 X |
| 3,961,240 | 6/1976 | Pohl | 324/402 X |
| 4,041,373 | 8/1977 | Maringer | 324/402 |

FOREIGN PATENT DOCUMENTS

| | | | |
|---|---|---|---|
| 2149307 | 4/1973 | Fed. Rep. of Germany | 324/402 |

*Primary Examiner*—Stanley T. Krawczewicz

[57] ABSTRACT

A portable electronic device for application in the diagnosis of automotive ignitions system failures is described. A novel probe is described, which can detect and differentiate the voltage on a typical ignition cable or spark plug. Means are provided to shield the differentiating sensor from extraneous fields and to process the differentiated signal to provide simple indications of failure of ignition system components and to identify such components for replacement.

7 Claims, 6 Drawing Figures

SHIELDED DIFFERENTIATOR FOR AUTOMOTIVE IGNITION APPLICATIONS

BACKGROUND OF THE INVENTION

In the operation, maintenance and repair of an internal combustion engine, it is often difficult to rapidly determine the specific cause of improper engine operation. This is particularly true in the case of the electrical ignition system, where faults in the high voltage section are often difficult to diagnose. Typical faults in such systems include fouled or shorted spark plugs as well as open or arcing cables. There are commercially available instruments to aid the mechanic in the diagnosis of ignition faults, the most successful to date being the modern engine analyzer which displays the high voltage waveforms for all of the spark plugs on a cathode ray tube. A highly trained mechanic can observe the variations in shape of the individual waveforms to determine which spark plug or cable is faulty.

It would be desirable to have instruments which are as effective as the cathode ray tube analyzer in diagnosing ignition faults, but which required much less training and expertise to operate and interpret. The present invention is useful in that regard; i.e. information is processed as it is detected so that it may be presented to the mechanic in a simplified form which requires minimal skill for correct interpretation.

Perhaps the most important aspect of the high voltage spark plug waveforms is a very rapid positive excursion after the voltage has reached levels in the range from about −7000 to −12,000 volts. This rapid (positive) rate of change towards zero voltage is a direct result of an arc which discharges the cable. In the case of a fouled spark plug, open cable or generally inoperative high voltage source, the arc will not occur and the rapid change in voltage will be absent.

In mathematical terminology, the rate of change of voltage is a derivative of voltage with respect to time, symbolized as dV/dt, where V represents voltage and t is time. In a typical case, the spark plug arc may cause the voltage to change from −10,000 volts to zero volts within approximately 0.2 microseconds. This rather rapid change in spark plug voltage corresponds to a derivative of $5\times10^{10}$ volts per second.

Since this high dV/dt is characteristic of an arc discharge, most of the common ignition failures are characterized by dV/dt which is much lower. See FIG. 3 for a comparison of waveforms; note the greatly reduced magnitude of the derivative when an arc does not occur.

The present invention obtains this derivative in an efficient manner, and provides means for processing the information about the magnitude of dV/dt so that it may be presented in a simple pass-fail format.

The most essential features of the present invention include:

(a) An electric probe which is capacitively coupled to the spark plug or spark plug cable.

(b) Circuitry to combine with the capacitance developed between the probe and the ignition cable or spark plug (such capacitance hereafter will be referred to as "probe capacitance") to form a voltage differentiating circuit.

(c) Means to provide electric shielding for the probe.

(d) Means to detect the level of the differentiated ignition voltage and further means to provide the operator with a visual indication of the amplitude of the differentiated voltage.

For example, the shielded probe may consist of two electrically conductive half-cylinders which are arranged to have a common axis. The inner cylindrical half-section would serve as the electric probe mentioned in (a) above while the outer half-cylinder would provide the electric shielding mentioned in (c) above. Probe capacitance, as stated in (b) above, would be that capacitance between the inner half-cylinder and the ignition component where voltage was being sensed. If the spark plug cable were being sensed by the probe, probe capacitance would essentially be between the spark plug cable conductor and the inner half-cylinder. Recall that probe capacitance is used not only to sense voltage, but also as a key element in a differentiating circuit. The differentiating circuit may combine the probe capacitance with combinations of resistance, inductance or operational amplifiers or the like to achieve the differentiating function.

Since probe capacitance is crucial to the differentiating function of the present invention, it is worthwhile to consider its geometry and typical values. The probe sensing electrode, which is the inner half-cylinder in the previous discussion, is placed around a spark plug cable so that its axis is coincident with the cable conductor. The probe capacitance for this arrangement is approximately:

$$C=[\pi Lel\ n(r_2/r_1)]\ \text{Farads}$$

where L is the length of the half-cylinder electrode in meters, e is the dielectric constant of the medium between the electrode and the cable conductor and $r_1$ and $r_2$ are the radius of the cable conductor and the probe electrode respectively. In a typical case, where L is 0.05 meters, e is $3\times8.8\times10^{-12}$ Farads per meter, $r_1$ is 0.5 mm and $r_2$ is 4 mm, the probe capacitance is 2 pF.

If this 2 pF capacitance is connected in series with 1000 Ohms resistance to form a differentiator, and if dV/dt is $5\times10^{10}$ volts per second, the peak differentiated voltage developed across the resistor would be approximately $$RC(dV/dt)=100\ \text{volts}$$

In this simple calculation, where R is the 1000 Ohm resistor and C is the 2 pF probe capacitance, one obtains the "order of magnitude" response for this type of differentiator. Actual response measured in a test settup with similar components ranged from 40 to 60 volts peak. When a simple differentiator is used, it is necessary to make the RC time constant smaller than the period of the highest frequency (in radians per second) that is to be differentiated. If an operational amplifier amplifier is used, as shown in FIG. 5, primary limitations on differentiation will be due to the upper break points or "poles" associated with the operational amplifier open loop gain or with the stabilizing circuitry. Complete circuitry utilizing an RC differentiator is shown in FIG. 1 and FIG. 4. FIG. 4 has the added feature of self-checking circuitry which operates when the power switch is depressed. This feature is realized by connection of one side of the pulse-stretching capacitor to the output of the power switch. This leads to a positive transient on the gate of the input transistor whenever the power switch is depressed, resulting in an output from the light emitting diode if the circuitry is operative and if the battery is sufficiently charged.

An operational amplifier is shown in FIG. 5; note the presence of resistance and capacitance elements to stabilize the differentiator.

Operation of the differentiating circuit can be enhanced by causing it to be especially sensitive to a more narrow band of frequencies. This can be accomplished by the addition of one or more inductive elements to resonate with probe or cable capacitance; one example is shown in FIG. 6. This inductive element (in FIG. 6), in combination with the probe capacitance can form a series resonant circuit whose bandwidth may be adjusted by setting the value of resistance in series with the inductor. This arrangement will enhance circuit selectivity and thereby reduce the sensitivity of the circuit to undesirable noise signals. By example, the frequencies present on the spark plug cable as a result of arc discharge might fall within the range of about 1 to 10 MHz, so that it would be useful to design for a center frequency of 3 MHz. For a series (probe) capacitance of 2 pF, the value of inductance required would be:

$$L=(4\pi^2 f^2 C)^{-1}=1.41 \text{ mHy}$$

Alternately, it is also possible to use the inductor to form a parallel resonant circuit in combination with cable capacitance. A typical value for cable capacitance is about 20 pF; the inductance required for a 3 MHz parallel resonance would be 0.141 mHy.

The choice of whether to enhance selectivity with either series or parallel resonance (or a combination of both) depends upon the relative values of probe capacitance and cable capacitance. If the two capacitance values could be adjusted, one could realize both parallel and series resonance at the same or at relatively close frequencies.

The invention described herein has been constructed and tested in several versions, both on a mock-up of a standard automotive "coil and breaker point" ignition system as well as on a variety of ignitions systems in automobiles. The most successful probe was constructed of two half-cylinders of metal which were separated by epoxy insulation and connected to the electronic monitoring circuitry by a short section of 50-Ohm cable. The chassis housing the electronic circuitry was metal, since earlier experiments with a plastic chassis did not provide enough shielding for the input section of the sensing/differentiating circuitry.

Tests conducted on the simulated ignition circuitry and on various automobiles proved that the present invention is quite capable of detecting spark plugs with fouled, shorted or eroded gaps. The invention is also capable of detecting any condition which isolates high voltage from the spark plug or the section of cable under test; this may include an open cable or a faulty autotransformer or a failed component at the lower voltage levels of the ignition system.

Since the present invention is effectively a differentiating arc-detector, it is less efficient at detection of spark plug cables which are arcing to ground than in detecting other more common faults. Some capability for detecting arcing cables (by not responding to the resultant dV/dt), may be achieved by adjustment of detector sensitivity or by displaying a continuous scale of dV/dt for observation by the mechanic. This is due to the fact that arcs which are remote from the spark plug (where the detector probe will normally be located), must discharge the probe capacitance through the spark plug cable impedance and therefore result in a lower dV/dt than when the arc is near the region of measurement.

The present invention may be used by the mechanic in a variety of ways, depending upon the exact configuration of the instrument. When a single differentiator and display unit is housed in a small chassis, the mechanic may check each spark plug or spark plug cable in a serial manner to determine which are likely to be faulty. If a number of the differentiator probes are available (eight for example), the mechanic may view the results on all spark plugs simultaneously. In this case, one might have a number of monitors and display modules which was equal to the number of shielded differentiator probes. Alternately, one might wish to multiplex the data for display or for input into a microprocessor-based data analysis system.

DESCRIPTION OF THE PREFERRED EMBODIMENT

Figure 1:
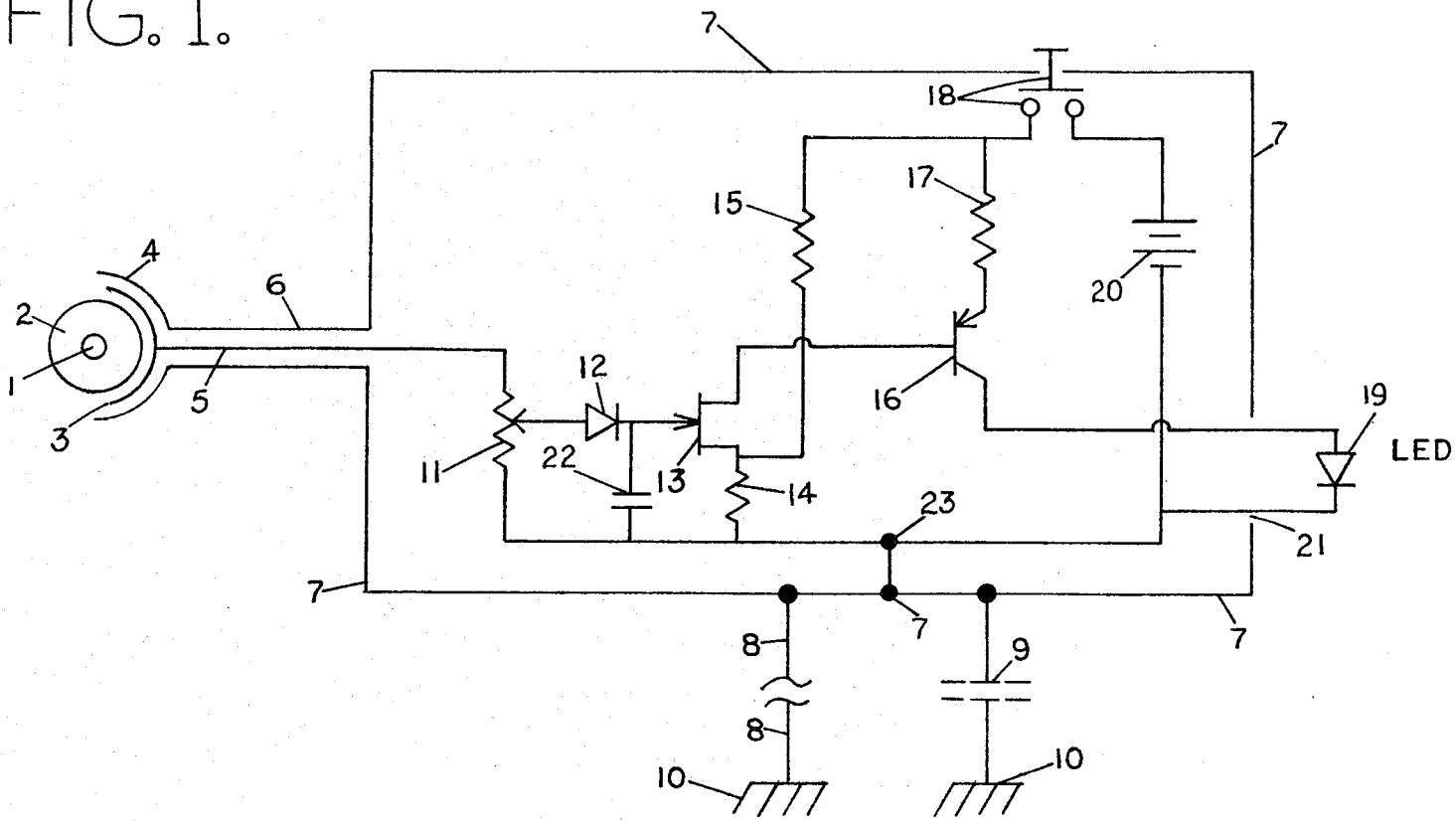
FIG. 1 is a schematic drawing of a complete portable shielded differentiator, illustrating one version of the electronic sensing and light-emitting diode display unit.

Referring now to FIG. 1, a schematic diagram illustrates the mode of operation of the present invention. Electrical conductor 1 in spark plug cable 2 is capacitively coupled to probe inner electrode 3 which is connected to potentiometer 11 through cable inner conductor 5. Potentiometer 11 serves both as a level-sensing element in combination with transistor 13 and bias resistor divider made up of resistor 14 and resistor 15 and as a differentiating resistance element when combined with probe capacitance. (Probe capacitance 24 is clearly defined in FIG. 2.) Continuing now with FIG. 1, diode 12 and pulse-stretching capacitor 22 sense positive voltages from the wiper of potentiometer 11 and provide lengthened pulses with durations on the order of several milliseconds to transistor 13. Amplified current from the drain of transistor 13 is provided to the base of transistor 16. This current is further amplified by transistor 16 and flows through emitter resistor 17 and through light-emitting diode 19 to provide a visual indication of the arc which has occurred through orifice 21 on chassis 7. The circuitry is energized by connecting battery 20 to the circuitry as switch 18 is depressed. Circuit return to ground 10 may be either through a conductive connection 8 or stray capacitance 9. Note that the circuit common 23 is connected to the chassis 7, as is any conductive return 8 to ground 10. Also note that the cable inner conductor 5 is shielded by conductive member 6 which is connected to shield electrode 4.

Figure 2:
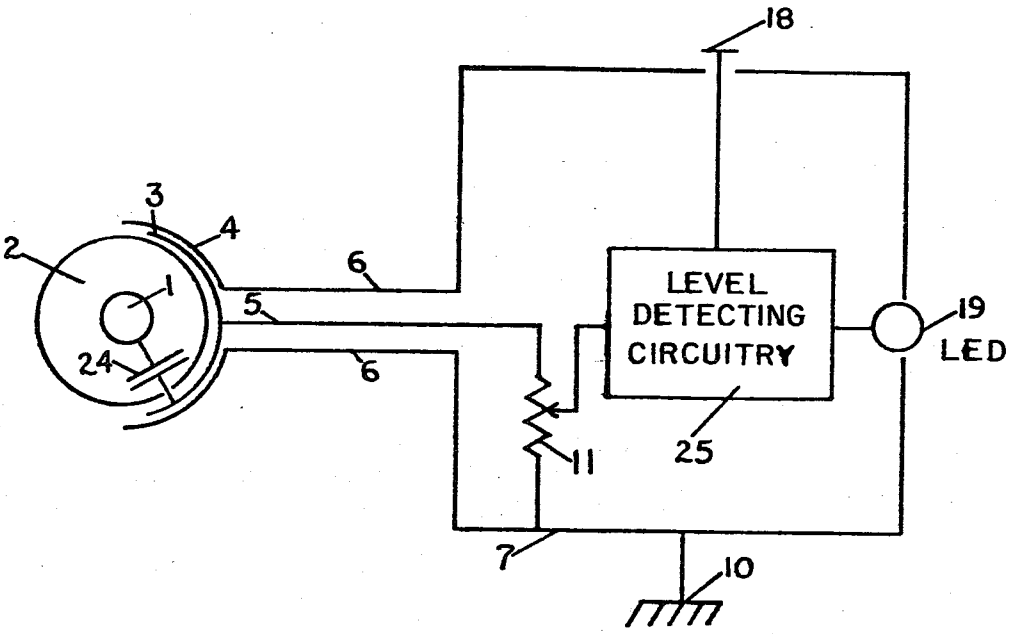
FIG. 2 shows greater detail of the relationship between a spark plug cable and the shielded differentiating sensor probe, particularly in identifying the probe capacitance between the probe inner electrode and the spark plug cable conductor.

Referring now to FIG. 2, it may be seen that probe capacitance 24 is formed by the close proximity of probe inner electrode 3 and the conductor 1 in spark plug cable 2. It may also be seen that probe capacitance 24, when connected in series with potentiometer 11 forms a differentiating circuit which may be mentioned by level-detecting circuitry 25 (as already detailed in FIG. 1), to drive a light-emitting diode 19.

Figure 3:
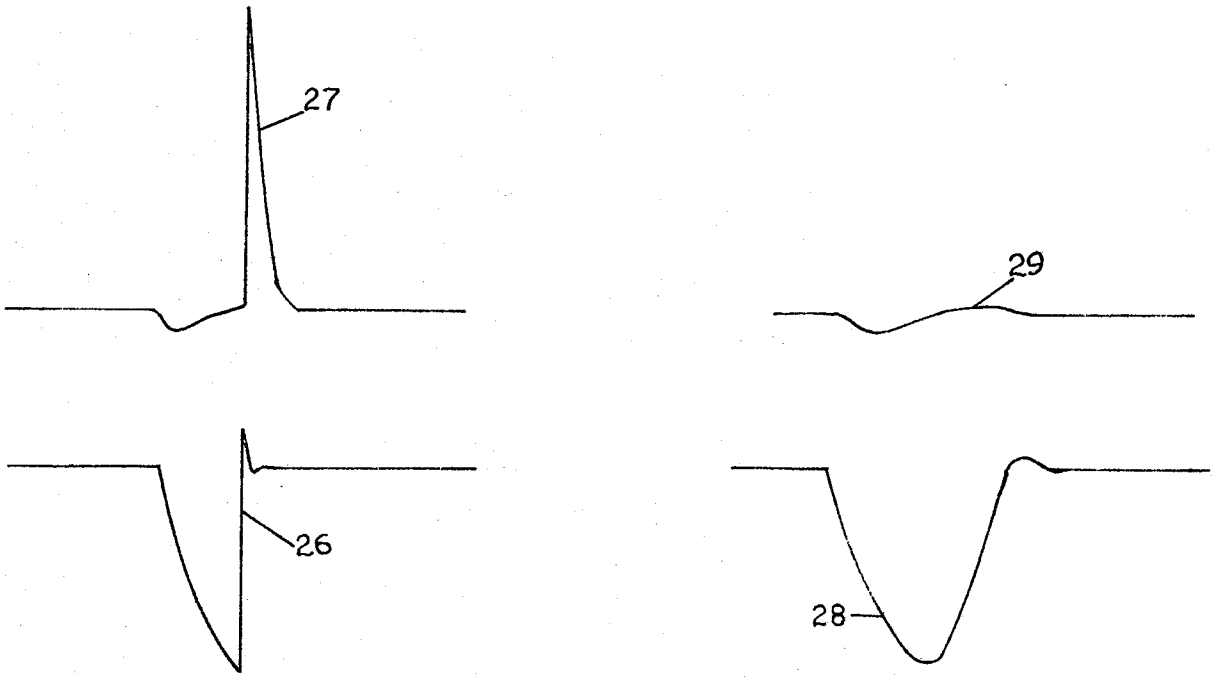
FIG. 3 illustrates both the normal and abnormal spark plug voltages and their derivatives.

Referring now to FIG. 3, a normal spark plug voltage waveform 26 exhibits a very rapid change in voltage towards zero levels when an arc occurs at the spark plug electrodes, and this waveform has a very large derivative 27 in comparison to the derivative 29 of an abnormal spark plug waveform 28, such as will result from a fouled spark plug.

Figure 4:
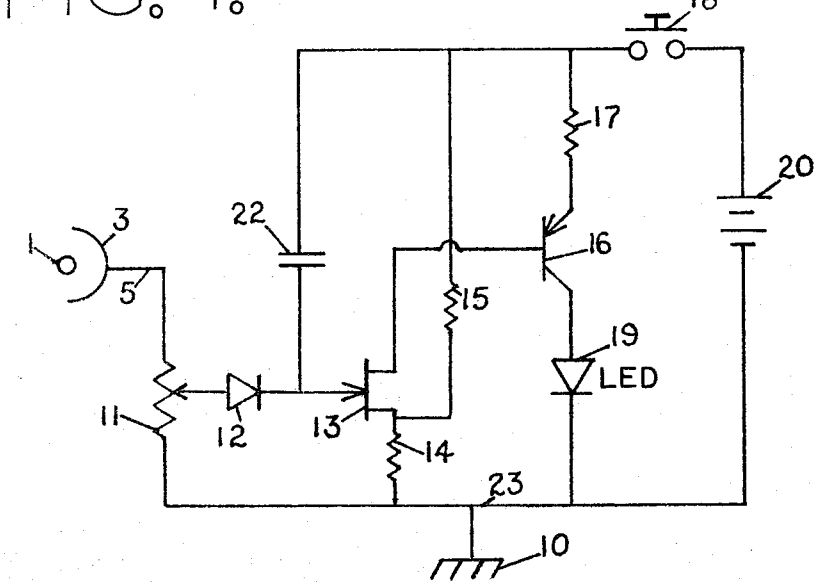
FIG. 4 illustrates a self-checking version of the circuitry shown in FIG. 1.

Referring now to FIG. 4, it may be seen that the configuration of this circuitry is quite similar to that of FIG. 1, except for the connection of pulse-stretching capacitor 22. In FIG. 4, the connection of pulse-stretching capacitor 22 causes a positive transient voltage to be developed on the gate of transistor 13 when switch 18 is depressed. Whenever switch 18 is closed, this transient voltage serves as a test signal to check out the circuitry and determine whether the battery 20 is sufficiently charged for normal circuit operation. If battery 20 is sufficiently charged and if all other components are functioning normally, this transient will cause a brief emission of light from light-emitting diode 19, to assure the mechanic that the instrument is functioning in a normal fashion.

Figure 5:
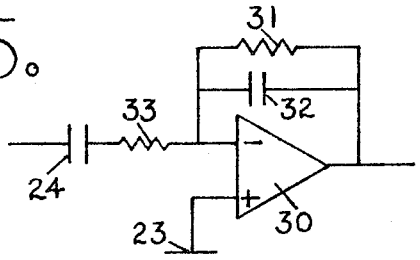
FIG. 5 illustrates how an operational amplifier may be used to realize the differentiating function in combination with probe capacitance.

Referring now to FIG. 5, an operational amplifier 30 is utilized in a differentiating configuration with probe capacitance 24 and resistance 31 being the differentiating elements and where resistance 33 and capacitor 32 act as the stabilizing elements.

Figure 6:
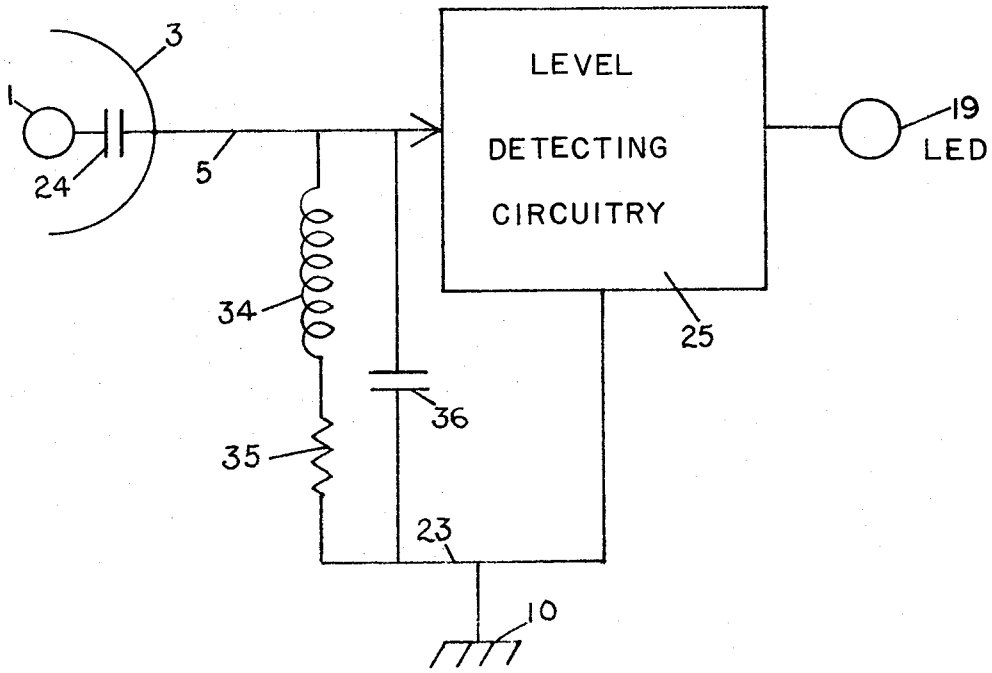
FIG. 6 illustrates one method for realizing a resonant differentiator where an inductor is added to create a resonant circuit in combination with one or more circuit capacitances, and particularly with probe capacitance or cable capacitance.

Referring now to FIG. 6, it is shown how an inductor 34 may be added in series with probe capacitance 24 to achieve resonant differentiation. Bandwidth may be set by resistance 35 which may be either a parasitic resistance associated with inductor 34 or may be a discrete resistance element.

Still referring to FIG. 6, it may be seen that as an alternative to the series resonance already described above, that parallel resonance may be realized by the combination of inductor 34 with cable capacitance 36. As a further alternative, both a series and parallel resonance may be realized by a combination of inductor 34, probe capacitance 24 and cable capacitance 36.

Referring now to FIG. 2 and to FIG. 6, circuit block 25 is intended to include the balance of circuitry shown in FIG. 1 and in FIG. 4 which was not specifically shown in FIGS. 2 and 6 for the sake of clarity.

It is to be clearly understood that the present invention is not limited to the specific methods shown for accomplishing the various features of the invention which have been shown herein; a variety of techniques and methods for utilizing and manufacturing the invention are likely to occur to those familiar with this field of art, but that the present invention may be carried out in methods not specifically set forth herein without departing from its spirit.

What I claim is:

1. A device which may be utilized to determine whether an arc is occurring in the high voltage section of an electric ignition system used on an internal combustion engine, comprising:

an electric probe assembly which consists of two electrodes; the first electrode being the probe inner electrode which may be capacitively coupled to an ignition system component such as a spark plug or spark plug cable wherein resultant capacitance is probe capacitance; the second electrode of said electric probe assembly is the shield electrode wherein said shield electrode is arranged to substantially shield said probe inner electrode from electric fields other than electric fields resulting from voltage on said ignition system component which is monitored by said electric probe assembly, and combination of said probe capacitance with appropriate means to develop a voltage signal which is substantially proportional to the rate of change of the voltage being monitored by said electric probe assembly on said ignition system component, and further means to provide a visual indication whenever said rate of change of voltage exceeds a preset value.

2. The invention as recited in claim 1, wherein said probe inner electrode and said shield electrode are half-cylinders of electrically conductive material, wherein the said probe inner electrode has a smaller radius than said shield electrode and wherein said half-cylinders are arranged to be concentric with each other and with the axis of said spark plug or spark plug cable which is to be monitored by said electric probe assembly.

3. The invention as recited in claim 1, wherein a differentiating circuit is formed by combination of a resistance element in series with said probe capacitance.

4. The invention as recited in claim 1, wherein a differentiating circuit is formed by connection of said probe capacitance as the differentiating capacitor in a conventional operational amplifier differentiator.

5. The invention as recited in claim 1, with the addition of an inductive element in series with said probe capacitance.

6. The invention as recited in claim 1 wherein a capacitor is utilized as a transient-generating device when the instrument power switch is depressed to energize the level-detecting circuitry wherein said transient-generating device is utilized to test operation of said level-detecting circuitry, and wherein the same capacitor which is utilized as a transient-generating device may also be utilized as a pulse-stretching device in said level-detecting circuitry.

7. The invention as recited in claim 1, wherein said visual indication is provided by a light-emitting diode.

* * * * *